United States Patent [19]

Haus

[11] 4,167,246

[45] Sep. 11, 1979

[54] APPARATUS FOR SPRAYING REFRACTORY LINING

[75] Inventor: Jan F. Haus, Allison Park, Pa.

[73] Assignee: J. G. Spin-L, Inc., Carnegie, Pa.

[21] Appl. No.: 853,247

[22] Filed: Nov. 21, 1977

[51] Int. Cl.[2] ..... B05B 3/00

[52] U.S. Cl. ..... 239/227

[58] Field of Search ..... 239/225, 227, 264, 265; 118/303, 313, 318, 323; 266/281

[56] References Cited

U.S. PATENT DOCUMENTS

| | | | |
|---|---|---|---|
| 3,416,732 | 12/1968 | Reiter | 239/227 |
| 3,797,745 | 3/1974 | Haus | 239/227 |
| 3,799,445 | 3/1974 | Marino | 239/264 |

*Primary Examiner*—James B. Marbert

*Attorney, Agent, or Firm*—Duffield & Lehrer

[57] ABSTRACT

A lining gun for spraying refractory lining on the interior of ladles and the like includes an elongated conduit which is suspended downwardly into the interior of the ladle. A reversible air motor rotates the conduit about its axis in one direction and then the other for approximately 360° in each direction. A first pair of mixing nozzles mounted adjacent the bottom of the conduit direct refractory material passing through the conduit onto the bottom of the ladle and a second pair of nozzles direct the refractory material onto the side walls of the ladle. A flow splitter and diverter valve mechanism mounted within the conduit adjacent the nozzles selectively allows the refractory material to pass either through the first pair of nozzles or the second pair.

13 Claims, 5 Drawing Figures

APPARATUS FOR SPRAYING REFRACTORY LINING

BACKGROUND OF THE INVENTION

The present invention is directed toward an apparatus for spraying refractory lining and more particularly toward an apparatus which is adapted to be suspended into the interior of a ladle and which uses a first pair of nozzles to coat the bottom of the ladle and thereafter uses a second pair of nozzles to coat the side walls of the ladle.

In the iron and steel industry, deep walled refractory bodies such as ladles, soaking pits and furnaces are subjected to extremely high temperatures over long periods of time. These high temperatures cause deterioration of the refractory linings of the bodies. After the lining has deteriorated to a certain point, the lining must be replaced or repaired before the ladle, etc. can be further used.

The interior surface of the ladles can be repaired in a number of different ways. One common repair which has come into common practice is to spray a protective coating of refractory material onto the interior of the ladle.

Refractory spraying apparatus for ladles and the like which has been in common use are hand operated devices. With these, a workman is required to enter the ladle and to hand spray the refractory material about the interior. Hand spraying of the ladles is an extremely time consuming job. Additionally, the quality of the job accomplished is only as good as the skill of the laborer.

A further problem encountered in hand spraying of ladles is the cooling time required before a workman can enter the ladle or furnace. For example, a ladle of ordinary and common size which has just been taken out of use will require between six to twelve hours to cool before a workman can enter the ladle to spray a new lining. The turn around time between cooling, spraying and drying of a ladle can be extremely detrimental to production rates in a steel mill as well as being costly.

There has, for some time, been a requirement in the industry for a ladle spraying apparatus which will operate automatically to deposit the lining in a controlled manner and also one which can spray the lining on immediately or shortly after the ladle is taken out of service without having to wait for the ladle to cool and be hand sprayed.

One refractory spraying apparatus which has been in use and which has overcome substantially all of the problems of the previous hand-held devices is described in U.S. Pat. No. 3,797,745. This patent includes a pair of nozzles mounted at the lower end of a conduit which is suspended into the interior of a ladle. The conduit is actually a pair of concentric conduits so that the dry refractory material and water could be brought down through the interior of the conduits thus allowing a nozzle to continuously rotate in one direction. The internal conduit carrying the water, however, had a tendency to wear excessively due to the passage of the refractory material over its outer surface. In addition, with only two nozzles, it was difficult to spray the bottom surface of the ladle.

SUMMARY OF THE INVENTION

The present invention overcomes the problems with this prior device by using a lining gun for spraying refractory lining on the interior of ladles and the like including an elongated conduit which is suspended downwardly into the interior of the ladle. A reversible air motor rotates the conduit about its axis in one direction and then the other. A first pair of nozzles mounted adjacent the bottom of the conduit directs refractory material passing through the conduit onto the bottom of the ladle and a second pair of nozzles directs the refractory material onto the sides of the ladle. A flow splitter and diverter valve mechanism mounted within the conduit adjacent the nozzles selectively allows the refractory material to pass either through the first pair of nozzles or the second pair.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE INVENTION

Figure 1:
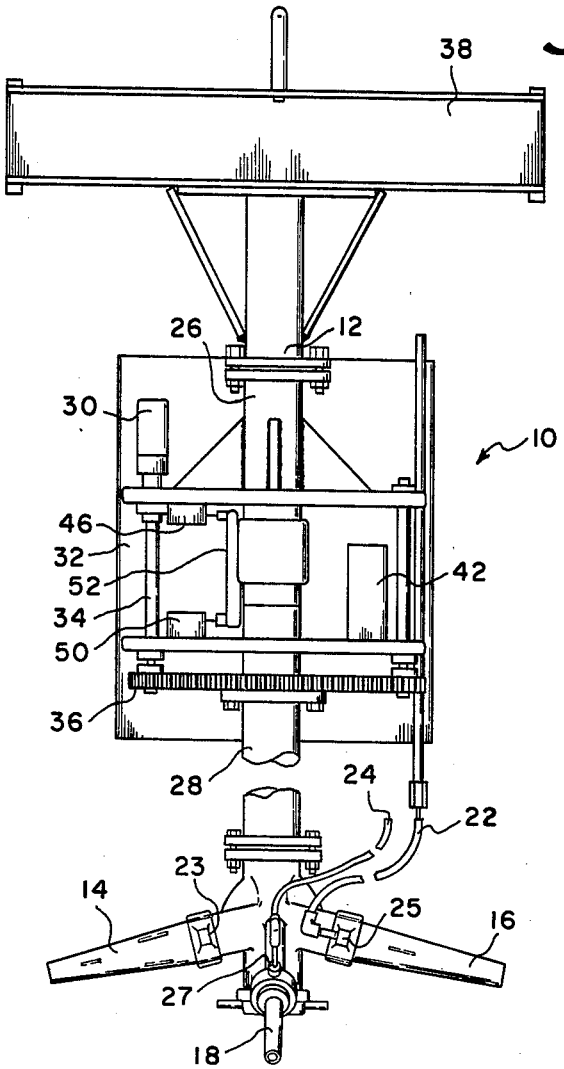
FIG. 1 is a front view of the spraying apparatus of the present invention.

Referring now to the drawings in detail, wherein similar reference numerals have been used through the various figures to identify like elements, there is shown in FIG. 1 a front view of a spraying apparatus constructed in accordance with the principles of the present invention and designated generally as 10.

Figure 3:
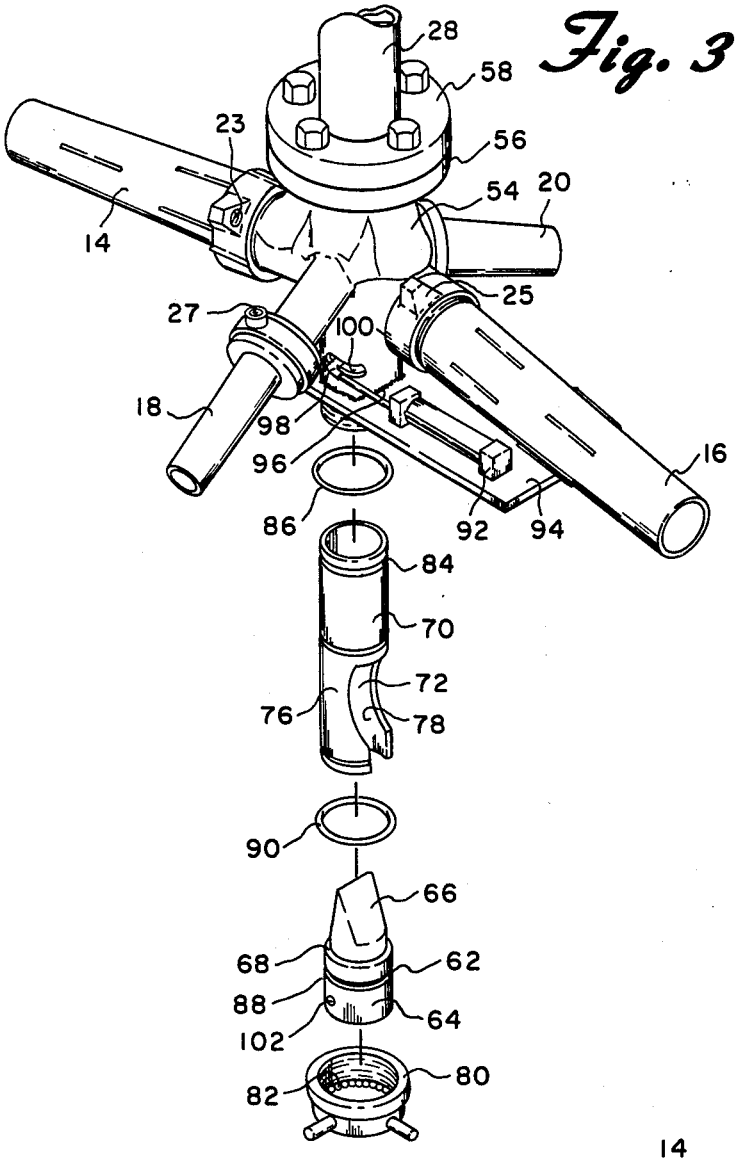
FIG. 3 is an exploded view of the nozzle section of the spraying apparatus.

The spraying apparatus or lining gun 10 includes an elongated conduit 12 through which dry refractory material may pass. Mounted adjacent the bottom of the conduit 12 are a plurality of nozzles 14, 16, 18 and 20 (FIG. 3). The nozzles 14–20 are also fed with water via flexible hoses 22 and 24 connected to suitable inlets 23, 25, 27 etc. The water mixes with the refractory material which enters the nozzles through the conduit 12 and the mixture is sprayed from the nozzles for coating the interior of the surface of the ladle or the like. As will be more fully described hereinafter, a valve mechanism within the conduit preferably allows the refractory material to pass either through nozzles 14 and 16 or through nozzles 18 and 20. Similarly, water or some other wetting agent is directed toward either nozzles 14 and 16 or 18 and 20 through valve means (not shown).

Conduit 12 is actually comprised of several parts: the upper part 26 which is angularly fixed and a lower part 28 which is mounted for rotation by suitable bearing means. A rotary coupling device connects the upper part 26 to the lower part 28. The bearings and rotary coupling device are not shown in detail since they are believed to be well known to one of ordinary skill in the art. In this regard, reference is made to applicant's prior U.S. Pat. No. 3,797,745 wherein similar devices are employed and described.

A reversible air motor 30 mounted on a frame 32 is adapted to rotate the conduit portion 28 and the nozzles affixed to the lower end thereof about the axis of the conduit. This is accomplished through drive shaft 34 of the air motor 30 which carries a pinion at the lower end thereof adapted to engage ring gear 36 which is fixed to the conduit section 28.

The entire assembly described above is designed to be suspended within a ladle or similar deep walled refractory body by means of a crane which is adapted to engage carriage assembly 38 which supports the remainder of the lining gun 10. The crane or similar lifting device (not shown) is used to move the lining gun through the vertical height of the ladle as the nozzles rotate. Again, reference is here made to applicant's prior U.S. Pat. No. 3,797,745 and particularly FIG. 1 thereof.

Unlike applicant's prior patent, the water is supplied to the spray nozzles externally through flexible hoses 22 and 24. As a result, the nozzles and conduit portion 28 cannot continuously rotate. Thus, according to one feature of the present invention, the nozzles and conduit portion 28 are adapted to alternately rotate in one direction for approximately 360° and then in the other direction for approximately 360°.

Figure 2:
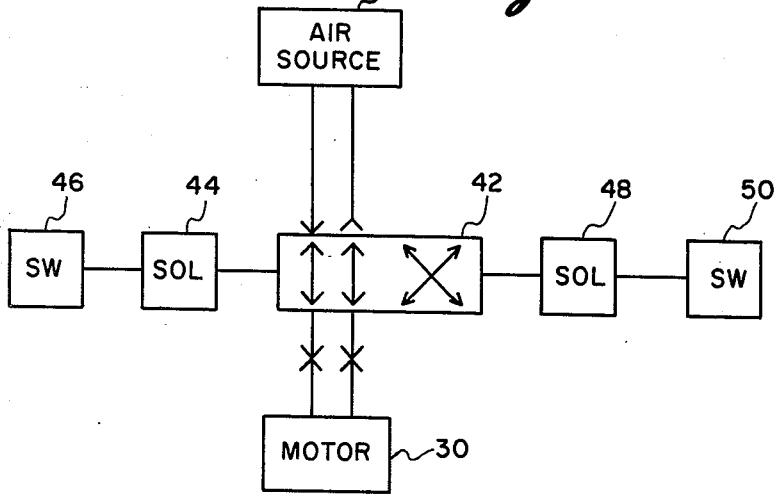
FIG. 2 is a schematic representation of the fluid drive and electrical control circuit.

To accomplish this reversing feature, the fluid and electrical circuit shown schematically in FIG. 2 is employed. This circuit is comprised of a source of air pressure 40 which is fed to the reversible air motor 30 through a four-way reversing valve 42. Activation of solenoid 44 by switch 46 places valve 42 in the position shown in FIG. 2 so that the motor 30 rotates in one direction. Similarly, activation of solenoid 48 by switch 50 moves the valve 42 to the left as shown in FIG. 2 thereby reversing the flow of air to the motor which in turn reverses the rotation motor 30. The schematic shown in FIG. 2 is by way of example only. Numerous other arrangements for accomplishing the same result are also possible and will be apparent to those skilled in the art.

Referring again to FIG. 1, it can be seen that a striker bar 52 is mounted on the lower portion 28 of conduit 12 so as to rotate therewith. As conduit portion 28 and striker bar 52 rotate in a given direction, striker bar 52 eventually contacts one of the switches 46 or 50 which are located in its path. This activates valve 42 thereby reversing the rotation of motor 30 and the conduit 28 which, of course, carries the nozzles. Rotation then continues in the reverse direction for approximately 360° wherein striker bar 52 contacts the other of the limit switches 46 and 50. This reversing operation continues as long as the lining gun is in use.

Figure 4:
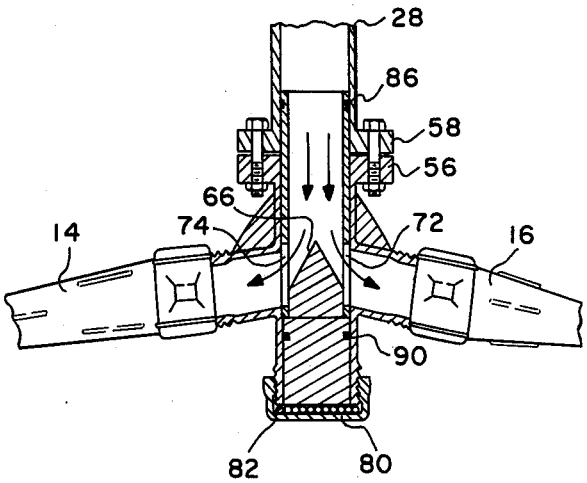
FIG. 4 is a cross-sectional view of the nozzle section of the spraying apparatus in a first condition.
Figure 5:
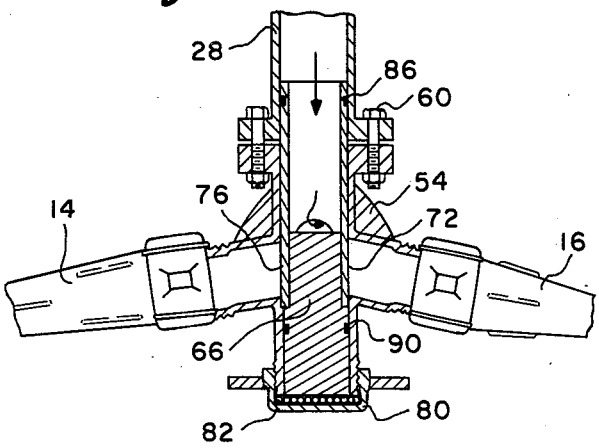
FIG. 5 is a view similar to FIG. 4 but showing the nozzle section in a second condition.

The details of the nozzle section of the lining gun 10 are shown most clearly in FIGS. 3, 4 and 5. It can there be seen that the first pair of nozzles 14 and 16 extend outwardly from the conduit portion 28 in substantially diametrically opposed directions. Similarly, the second pair of nozzles 18 and 20 also extend outwardly from the conduit 28 in substantially diametrically opposed directions. However, nozzles 18 and 20 extend substantially more downwardly than do nozzles 14 and 16, that is, nozzles 18 and 20 extend from the conduit at a different angle from the axis of the conduit than nozzles 14 and 16. In addition, nozzles 14 and 16 are angularly offset from nozzles 18 and 20 by approximately 90°.

As shown in FIGS. 3–5, the nozzles are actually affixed to a housing 54 which includes a flange 56 connected to a similar flange 58 located in the lower end of conduit 28. Thus, the interior walls of the housing 54 are, for all intents and purposes, a continuation of the conduit 28. Whenever desired, however, housing 54 can be removed from the conduit 28 by removing the bolts 60 which connect the two flanges.

Located within the housing 54 and coaxial with the conduit 28 is a flow splitter 62. Flow splitter 62 has a substantially cylindrically shaped lower portion 64 and an upper portion having opposed tapered faces 66. A radially extending annular ledge 68 divides the lower and upper portions of the flow splitter 62. The purpose of the flow splitter is believed to be apparent from FIG. 4. The opposed tapered faces 66 divide the refractory material coming from the conduit 28 into substantially two equal parts so that the material may pass substantially equally through the two opposed nozzles. This feature is described more fully in applicant's prior U.S. Pat. No. 3,797,745.

The upper end of the flow splitter 62 is inserted into a diverting collar 70. Diverting collar 70 includes opposed openings 72 and 74 at the lower end thereof which are adapted to be aligned with the opposing faces 66 of the flow splitter 62. Between the openings 72 and 74 are opposed solid wall portions 76 and 78. The bottom edge of the diverting collar 70 is adapted to rest on the ledge 68 and the two components are secured together by welding or by any other known technique. The outer diameter of the diverting collar 70 and the outer diameter of the lower portion 64 of the flow splitter 62 are substantially the same and are slightly less than the interior diameter of the conduit 28 and the housing 54. Thus, as shown in FIGS. 4 and 5, the combined flow splitter 62 and diverting collar 70 are adapted to fit within the lower portion of the conduit 28 and the housing 54. However, the fit is loose enough to allow rotary movement between the flow splitter and diverting collar unit on the one hand and the housing 54 on the other.

A cap 80 screwed onto the bottom of the housing 54 maintains the flow splitter and diverting collar unit within the housing. A plurality of ball bearings 82 interposed between the cap 80 and the bottom of the flow splitter 62 reduce the friction between these two components so that the flow splitter and diverting collar unit can be rotated. The upper end of diverting collar 70 includes an annular groove 84 into which is inserted an O-ring 86. This prevents any refractory material passing through the conduit 28 from entering the space between the diverting collar 70 and the inner walls of the housing 54. Similarly, the lower portion 64 of the flow splitter 62 includes a groove 88 into which is placed an O-ring 90. This seal prevents refractory material from passing through to the bottom of the flow splitter 62 and interfering with the ball bearings 82.

As shown in FIGS. 4 and 5, the flow splitter 62 and diverting collar 70, as a unit, can be rotated between a first position wherein the faces 66 of the flow splitter are directly opposite the openings in the housing 54 leading to the nozzles 14 and 16. In this position, the openings 72 and 74 in the diverting collar 70 coincide with the nozzles 14 and 16 and accordingly, refractory material flowing downwardly through the conduit 28 passes through the nozzles 14 and 16. At the same time, however, the solid walls 76 and 78 of the diverting collar 70 coincide with the openings leading to the nozzles 18 and 20 and accordingly, these nozzles are blocked and no refractory material will pass there through.

When the flow splitter 62 and diverting collar 70 are rotated 90°, the walls 76 and 78 are aligned with the nozzles 14 and 16 thereby effectively shutting off these nozzles. At this time, however, openings 72 and 74 are aligned with the nozzles 18 and 20 and the opposed tapered faces 66 of the flow splitter divide the refractory material substantially equally passing equal portions through the nozzles 18 and 20. Thus, the diverting collar functions as a valve to open either nozzles 14 and 16 or nozzles 18 and 20.

Rotation of the flow splitter 62 and diverting collar 70 is accomplished by a cylinder 92 mounted on a plate 94 securely attached to the housing 54. The forward end of the piston rod 96 of cylinder 92 includes a pin 98 which passes through an elongated opening 100 in the side wall of the housing 54. The other end of pin 98 is inserted into opening 102 in the base 64 of the flow splitter 62. Thus, by activating cylinder 92 the flow splitter 62 and diverting collar 70 can be moved between the two positions shown in FIGS. 4 and 5. Simultaneously with the activation of cylinder 92, appropriate valves (not shown) are activated so that the water or other wetting agent flows only to the active nozzles.

The lining gun 10 described above is used in the following manner. Preliminarily, cylinder 92 is activated so that nozzles 14 and 16 are closed and 18 and 20 are open. The lining gun 10 is then suspended in a ladle or other deep walled refractory body and air motor 30 is activated. Refractory material mixed with the water entering nozzles 18 and 20 is then sprayed from these nozzles as the conduit section 28 and all of the nozzles rotate in the manner described above.

Since nozzles 18 and 20 extend outwardly and downwardly, the material sprayed from these nozzles coats the bottom of the ladle. As the lining gun 10 is gradually raised, the pattern of the sprayed refractory material spreads outwardly so that the entire bottom is coated. As the lining gun 10 is raised further and the bottom of the ladle is completed, cylinder 92 is again activated so that nozzles 18 and 20 are closed and 14 and 16 are opened. At the same time, the water or other wetting agent is shut off to nozzles 18 and 20 and is directed toward nozzles 14 and 16. Conduit 28 and the nozzles continue to rotate and the lining gun 10 continues to be moved vertically so that all of the side walls of the ladle are coated.

The present invention may be embodied in other specific forms without departing from the spirit or essential attributes thereof, and accordingly, reference should be made to the appended claims, rather than to the foregoing specification as indicating the scope of the invention.

I claim:

1. A lining gun for spraying a refractory lining on the interior of deep walled refractory bodies such as ladles and the like comprising:

an elongated conduit through which refractory material can be conveyed;

at least one pair of discharge nozzles mounted adjacent one end of said conduit and being capable of being in fluid communication with said conduit, said nozzles extending outwardly from said conduit in substantially diametrically opposed directions; and drive means for driving said nozzles in a rotary manner about the axis of said conduit, said drive means alternately rotating said nozzles in a first direction through an angle of approximately 360° and then in the reverse direction through an angle of approximately 360°.

2. The lining gun of claim 1 further including divider means within said conduit and adjacent said nozzles for dividing the flow of refractory material within said conduit substantially equally between said nozzles.

3. The lining gun of claim 1 further including substantially flexible hose means connected to said nozzles for conducting a wetting agent thereto which is intended to be mixed with said refractory material.

4. The lining gun of claim 1 further including a second pair of nozzles mounted adjacent said first mentioned pair and also being capable of being in fluid communication with said conduit.

5. The lining gun of claim 4 further including means for selectively placing either said first or said second pair of nozzles into fluid communication with said conduit.

6. A lining gun for spraying a refractory lining on the interior of deep walled refractory bodies such as ladles and the like comprising:

an elongated conduit through which refractory material can be conveyed;

first and second nozzle means mounted adjacent one end of said conduit and being capable of being in fluid communication with said conduit;

means for selectively placing either said first or second nozzle means into fluid communication with said conduit, and drive means for driving said first and second nozzle means in a rotary manner about the axis of said conduit.

7. The lining gun of claim 6 wherein said drive means alternately rotates said first and second nozzle means in a first direction through an angle of approximately 360° and then in the reverse direction through an angle of approximately 360°.

8. The lining gun of claim 6 wherein said first and second nozzle means extend outwardly from said conduit at different angles from the axis of said conduit.

9. The lining gun of claim 6 wherein said first nozzle means includes a pair of nozzles which extend outwardly from said conduit in substantially diametrically opposed directions and wherein said second nozzle means includes a pair of nozzles extending outwardly from said conduit in substantially diametrically opposed directions, said first nozzle means being angularly offset from said second nozzle means.

10. The lining gun of claim 9 further including divider means within said conduit and adjacent said first and second nozzle means for dividing the flow of refractory material within said conduit substantially equally between the pair of nozzles of said first nozzle means or the pair of nozzles of said second nozzle means.

11. The lining gun of claim 9 wherein said first and second nozzle means extend outwardly from said conduit at different angles from the axis of said conduit.

12. The lining gun of claim 11 further including divider means within said conduit and adjacent said first and second nozzle means for dividing the flow of refractory material within said conduit substantially equally between the pair of nozzles of said first nozzle means or the pair of nozzles of said second nozzle means.

13. The lining gun of claim 12 including means for moving said divider means between a first position wherein the flow of refractory material is divided between the pair of nozzles of said first nozzle means and a second position wherein the flow of refractory material is divided between the pair of nozzles of said second nozzle means, said means for moving being operatively associated with said means for selectively placing either said first or second nozzle means into fluid communication with said conduit.

* * * * *